US010775106B2

(12) United States Patent
Czyz et al.

(10) Patent No.: US 10,775,106 B2
(45) Date of Patent: Sep. 15, 2020

(54) PLASTIC MATERIAL INTERNAL HEAT EXCHANGER

(71) Applicant: Hanon Systems, Daejeon (KR)

(72) Inventors: Petr Czyz, Hodslavice (CZ); Petr Daniel, Valasske Mezirici (CZ); Radim Cech, Studenka (CZ); Peter Heyl, Cologne (DE)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 15/868,024

(22) Filed: Jan. 11, 2018

(65) Prior Publication Data

US 2018/0195806 A1 Jul. 12, 2018

(30) Foreign Application Priority Data

Jan. 11, 2017 (DE) ..... 10 2017 100 460

(51) Int. Cl.

| | |
|---|---|
| ***F28D 7/00*** | (2006.01) |
| ***F28F 21/06*** | (2006.01) |
| ***F28F 1/02*** | (2006.01) |
| ***F28F 9/02*** | (2006.01) |
| ***F28F 7/02*** | (2006.01) |
| ***F28F 1/06*** | (2006.01) |
| ***F25B 40/00*** | (2006.01) |
| ***F28D 7/10*** | (2006.01) |

(Continued)

(52) U.S. Cl.

CPC ..... *F28D 7/0066* (2013.01); *F25B 40/00* (2013.01); *F28D 7/0008* (2013.01); *F28D 7/0041* (2013.01); *F28D 7/10* (2013.01); *F28F 1/00* (2013.01); *F28F 1/022* (2013.01); *F28F 1/06* (2013.01); *F28F 7/02* (2013.01); *F28F 9/0248* (2013.01); *F28F 9/0256* (2013.01); *F28F 21/062* (2013.01); *F28D 2021/008* (2013.01); *F28D 2021/0068* (2013.01); *F28F 2275/02* (2013.01); *F28F 2275/06* (2013.01); *F28F 2275/062* (2013.01); *F28F 2275/12* (2013.01)

(58) Field of Classification Search

CPC ..... F28D 7/0025; F28D 7/103; F28D 7/0066; F28D 7/0008; F28D 7/0041; F28D 7/10; F28D 7/02; F25B 40/00

USPC ..... 165/154, 157

See application file for complete search history.

(56) References Cited

U.S. PATENT DOCUMENTS 596,330 A * 12/1897 Maiche ..... F28F 7/02 165/164
3,851,494 A * 12/1974 Hess ..... F25B 1/00 62/196.1

(Continued)

FOREIGN PATENT DOCUMENTS

DE 3614342 A1 10/1987
DE 102007044980 A1 3/2008

(Continued)

*Primary Examiner* — Jianying C Atkisson
*Assistant Examiner* — Jose O Class-Quinones
(74) *Attorney, Agent, or Firm* — Norton Rose Fulbright US LLP; James Crawford

(57) ABSTRACT

The invention relates to a device for heat exchange, in particular in a refrigerant circuit, with at least one first flow path and at least one second flow path, which, in a cross section perpendicular to a longitudinal direction of the device, are disposed coaxially with respect to one another, and each of which comprises at least one flow channel. The device is realized of a synthetic material.

15 Claims, 5 Drawing Sheets

Figure 1A:
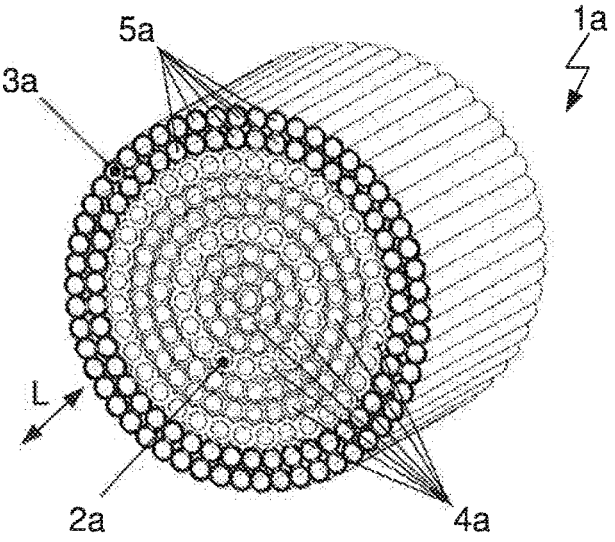

(51) Int. Cl.
*F28F 1/00* (2006.01)
*F28D 21/00* (2006.01)

(56) References Cited

U.S. PATENT DOCUMENTS

| | | | | | |
|---|---|---|---|---|---|
| 4,343,354 | A * | 8/1982 | Weber | F28F 7/02 | 165/165 |
| 4,782,892 | A * | 11/1988 | Ostbo | F28D 7/0041 | 165/164 |
| 5,309,637 | A * | 5/1994 | Moriarty | B23P 15/26 | 228/183 |
| 6,374,598 | B1 * | 4/2002 | Neuschwander | F28D 7/106 | 165/154 |
| 2005/0016721 | A1 * | 1/2005 | Antonijevic | B60H 1/00571 | 165/177 |
| 2010/0206001 | A1 * | 8/2010 | Takahashi | B60H 1/323 | 62/498 |
| 2010/0300666 | A1 * | 12/2010 | Hislop | B23K 1/0056 | 165/173 |
| 2012/0199326 | A1 * | 8/2012 | Sheldon | F25B 40/00 | 165/154 |
| 2012/0222845 | A1 * | 9/2012 | Kinder | F28F 13/12 | 165/154 |

FOREIGN PATENT DOCUMENTS

| | | | |
|---|---|---|---|
| DE | 102012100722 | A1 | 9/2012 |
| JP | 3059203 | U | 7/1999 |
| JP | 2010096225 | A | 4/2010 |
| KR | 20040027744 | A | 4/2004 |

* cited by examiner

PLASTIC MATERIAL INTERNAL HEAT EXCHANGER

This application claims priority under Section 119 from German Patent Application No. 102017100460.2 filed Jan. 11, 2017, which is hereby incorporated by reference in its entirety.

The invention relates to a device for heat exchange, in particular in a refrigerant circuit, with at least one first flow path and at least one second flow path, which, in a cross section perpendicular to a longitudinal direction of the device, are disposed coaxially with respect to one another, and each of which comprises at least one flow channel. The device is realized of a synthetic material.

Due to their large number, the demands inter alia made quite generally of the technical components of modern motor vehicles are, at least at constant or greater efficiency, minimizing weight as well as volume in order to limit, on the one hand, the fuel consumption and, on the other hand, to ensure the desired functionality by installing all components in the low designed space of the motor vehicle. The implementation and disposition of the components must be combined in a manner that saves space and costs.

Specifically for conditioning the air of the passenger compartment, motor vehicles disclosed in prior art comprise an air-conditioning system with a refrigerant circuit. To raise the efficiency during operation, expressed as coefficient of performance, as well as to increase the cooling capacity, the refrigerant circuit, dependent on the refrigerant, is implemented with a so-called internal heat exchanger. For example, separate coaxial tube heat exchangers or plate heat exchangers are employed as internal heat exchangers as well as combined components, comprised of an accumulator or an evaporator, each with an internal heat exchanger.

By internal heat exchanger is here understood a heat exchanger internal to the refrigerant circuit, which serves for heat transfer between the refrigerant at high pressure and the refrigerant at low pressure. After condensation or liquifaction, the liquid refrigerant is herein further cooled, on the one hand, and, on the other hand, the suction gas is superheated before entering a compressor. Heat is transferred from the refrigerant at high pressure to the refrigerant at low pressure.

Conventional coaxial tube heat exchangers are primarily constructed of aluminum and are operated according to the counter flow principle which ensures good heat transfer and efficient heat exchange with the least possible temperature differences.

In order to reduce in particular the weight as well as the cost of production of the components of a refrigerant circuit, the use of synthetics as their material is currently pursued. In some motor vehicles, for example, the high-pressure line of the refrigerant circuit is already produced of synthetic material.

The material-specific properties of the synthetic and of the refrigerant at high-pressure permit using an approximately identical design of the high-pressure line of synthetic material, in particular of the connection of peanut fittings as connection technology with the tube.

The weight as well as also the cost of the production would increase markedly if a similar design of the coaxial tube heat exchanger were realized of a synthetic material compared to a realization of aluminum. The wall thicknesses of conventional coaxial tube heat exchangers of aluminum are low. The tube charged with refrigerant at low-pressure is constructed with a large diameter. When transferring the diameter to a tube developed of a synthetic material, in particular a plastic material, the wall thickness, and therewith also the weight, increases considerably.

KR 2004 0027744 A discloses a synthetic double tube implemented of an outer tube and an inner tube disposed coaxially with the outer tube. The synthetic double tube comprises fins which, oriented perpendicularly to the outer circumference of the inner tube and to the inner circumference of the outer tube, extend between the inside of the outer tube as well as the outside of the inner tube and are disposed at uniform spacing on the circumference. The inner tube with its inner radius has a circular continuous first flow cross section while the second flow cross section between the inner tube and the outer tube is divided by the fins into sections of identical size.

JP 3059203 also discloses a double tube developed of an outer tube and an inner tube disposed coaxially with the outer tube. The outer tube is produced of a pressure-resistant material and the inner tube is produced of a synthetic material. The inner tube has a continuous first flow cross section while the second flow cross section between the inner tube and the outer tube is divided by centering elements disposed spaced apart in the direction of the longitudinal axis as well as also over the circumference.

The invention addresses the problem of providing a device for the heat exchange in particular in a refrigerant circuit for internal heat exchange. The cost of production and the weight of the device are to be minimal, specifically in comparison with devices of aluminum. The constructed size of the device is also to be minimal. The device is to be operatable at maximal efficiency, with the efficiency of the process of heat exchange to be within the range of the efficiency of the devices of aluminum.

The problem is resolved through the subject matters with the characteristics of the independent patent claims. Further developments are specified in the dependent patent claims.

The problem is resolved through a device according to the invention for heat exchange, in particular in a refrigerant circuit, for example an air-conditioning system of a motor vehicle. The device is implemented with at least one first flow path and at least one second flow path which, in a cross section perpendicular to a longitudinal direction of the device, are disposed coaxially with respect to one another, with each having at least one flow channel. A wall of the at least one flow channel of at least one flow path is herein implemented of a synthetic material.

According to the concept of the invention, the flow paths are each implemented of a multiplicity of flow channels. By multiplicity is here to be understood a number of at least two.

The device advantageously has a cylindrical shape, in particular a circular cylindrical shape, with a circular cross section in the longitudinal direction. The cross section can herein also be developed in different shapes. It can, for example, have the shape of a trapezoid, a triangle, an oval, an ellipse, a rectangle or the like. In addition, cross sections of combinations of different shapes are also feasible.

According to a further development of the invention, at least one flow path is implemented of a multiplicity of flow channels, each with a circular flow cross section. The flow cross sections can have different diameters.

A wall of a flow path, in particular that of the at least one flow channel of the at least one second flow path, is advantageously realized of a metal, in particular of aluminum. The entire device is alternatively comprised of a synthetic material. Among the synthetic materials are polyamides including aliphatic, aromatic as well as also long-chain aromatic polymers in general and polypropylene.

To improve the heat transfer properties, walls of the flow paths, furthermore, can also be implemented of a combination of synthetic material and metal or metal alloys. The feasibility is herein given that, to improve the heat transfer properties, a first portion of the walls is realized of a combination of synthetic material and metal or metal alloy as well as a second portion of the walls of a metal, in particular aluminum.

According to a first alternative implementation, each flow channel is developed with a separate wall. Herein the walls of adjacently disposed flow channels are in contact with one another.

According to a second alternative implementation each flow channel is delimited by a wall, wherein in each instance adjacently disposed flow channels are separated from one another by a common wall.

According to an advantageous implementation of the invention, a first flow path, disposed in the proximity of an axis of symmetry of the device, has a circular shape in cross section. The flow channels of a second flow path are disposed coaxially about the first flow path and have in their entirety a circular ring shape. In the implementation of a multiplicity of flow channels of the first flow path in the proximity of the axis of symmetry of the device, these flow channels have in their entirety a circular shape.

Starting from the axis of symmetry toward the outside, flow channels of a first flow path are preferably disposed coaxially about flow channels of a second flow path which, in their entirety, have the shape of a circular ring. Therewith at least one second flow path is disposed such that it is delimited by two first flow paths. Moreover, flow channels of a further second flow path can be disposed coaxially about flow channels of a first flow path which, in their entirety, again have a circular ring shape.

The flow channels are herein advantageously disposed in a single row or in multiple rows. By multiple rows is here to be understood a number of at least two rows.

In the longitudinal direction the flow channels are preferably disposed such that they are aligned parallel to one another.

A further advantageous implementation of the invention comprises that at least one flow path, in a cross section perpendicular to the longitudinal direction, is circular ring-shaped, wherein the flow path is divided into partial circular ring-shaped flow channels by webs oriented in the direction of a radius. In the webs can be developed flow channels which preferably have circular flow cross sections.

According to a further development of the invention, in each of the front faces of the device a connection element for the first flow path and a connection element for the second flow path or a combination connection element for the flow paths is disposed, in which are disposed connection flow channels continuing the flow channels of the first flow paths in the longitudinal direction and at least one ring channel is implemented as a connection flow channel of the second flow paths. The at least one ring channel connects the volumes of the second flow channels with one another.

The ring channel, moreover, advantageously comprises an outlet opening into which a connection line opens out. The connection line is preferably disposed at an angle perpendicular to the longitudinal direction.

The advantageous implementation of the invention, in particular in view of constructed size and weight, permits the use of the device as an internal heat exchanger in a refrigerant circuit, in particular in an air-conditioning system for conditioning the air of a passenger compartment of a motor vehicle. In the internal heat exchanger heat is transferred between the refrigerant at high-pressure level and the refrigerant at low-pressure level. Depending on the implementation of the device, in a feasible combination of the materials synthetic and metal, in particular aluminum, the refrigerant at high-pressure level is conducted through the components of aluminum and the refrigerant at low-pressure level through the components of synthetic material or the refrigerant at high-pressure level is conducted through the components of synthetic material and the refrigerant at low-pressure level through the components of aluminum.

The employment of aluminum serves also for the improvement of heat conduction. The employment of synthetic material on the outside of the device, i.e. the side in contact with the surroundings, decreases the heat loss or the heat input and therewith the heat exchange with the ambient surroundings. Herein the refrigerant at high-pressure level with higher temperature than the refrigerant at low-pressure level is preferably conducted in the outer region of the device since the refrigerant at high-pressure level most frequently is also warmer than the adjacent surroundings.

In summary, the device according to the invention for heat exchange in a motor vehicle comprises further diverse advantages:

- utilization of the material-specific properties of the synthetic material to provide efficient components that reduce weight and are cost effective, wherein the minimal weight, moreover, leads to lesser wear of the motor vehicle,
- replacement or exchange of a conventional device with at least approximately identical or identical outer dimensions, such as length and outer diameter, wherein the constructed size is minimal,
- recyclability of the material of the device,
- low cost considering the entire life cycle including raw materials production, manufacture, maintenance, disassembly and recycling as well as
- maximal efficiency of the device in operation, wherein the efficiency of the process of heat exchange is in the range of the efficiency of the devices realized of aluminum.

Figure 1B:
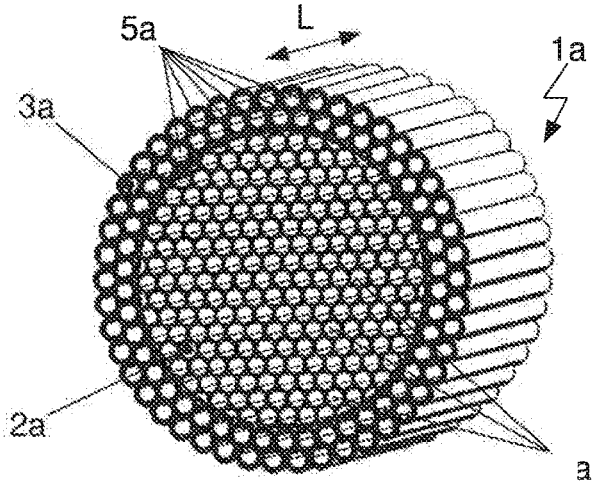
Figure 1C:
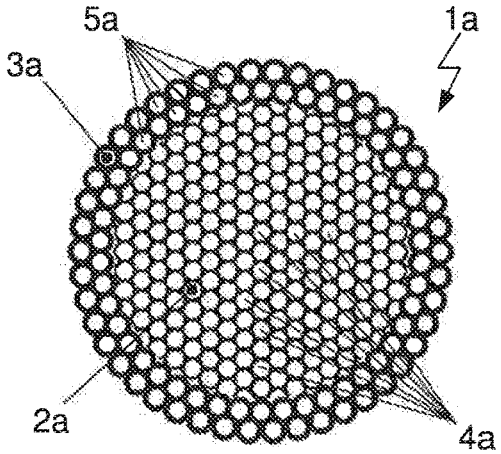
Figure 1D:
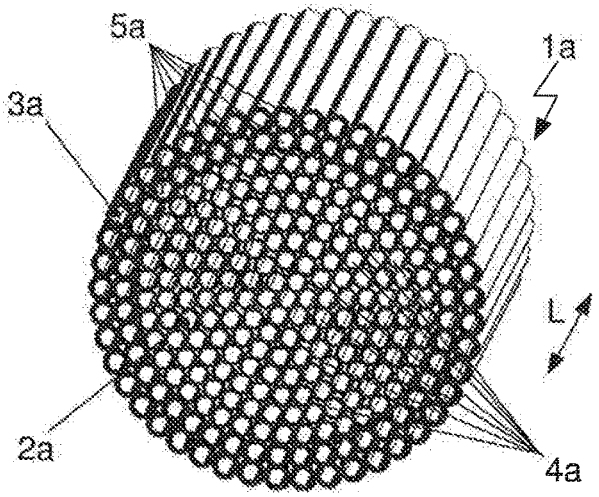
Figure 1E:
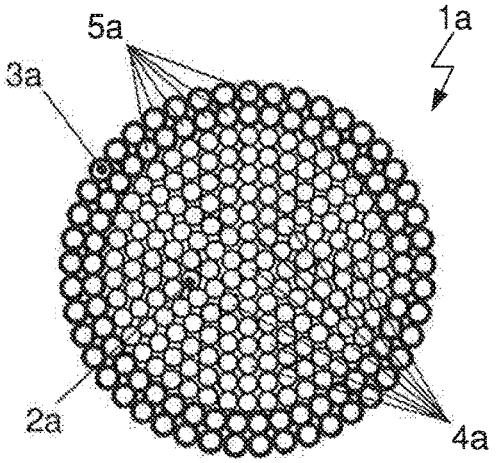
Figure 2:
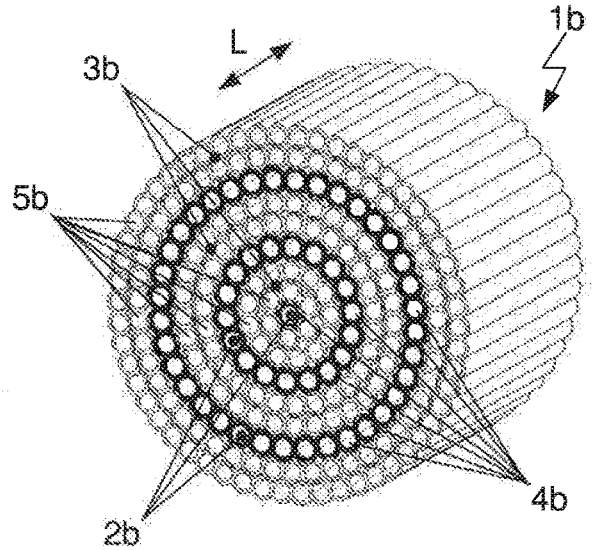
Figure 3A:
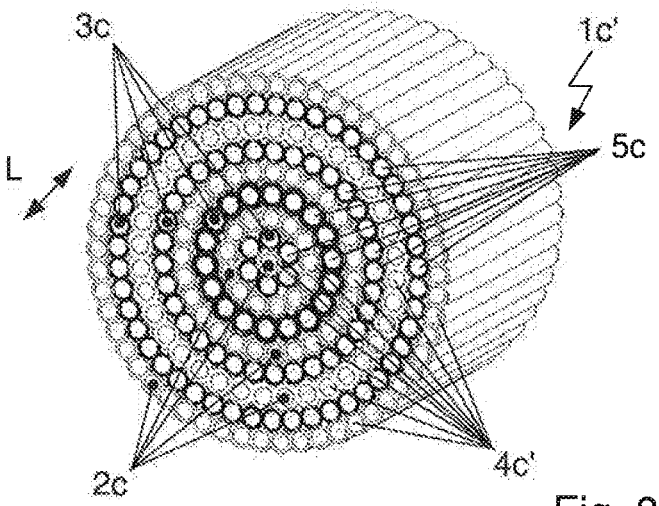
Figure 3B:
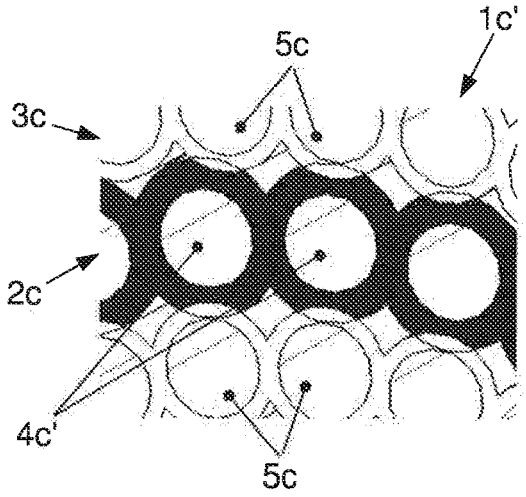
Figure 3C:
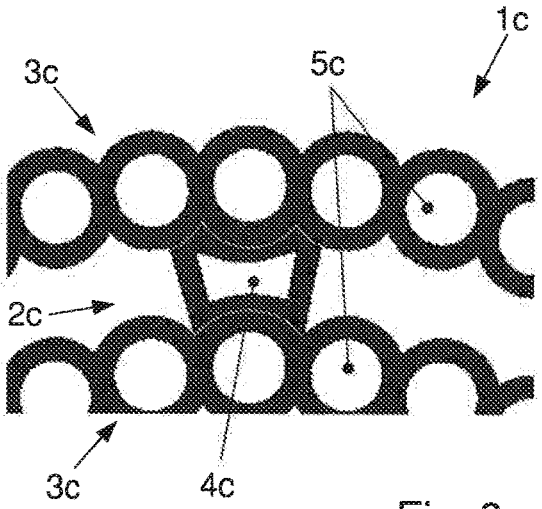
Figure 4:
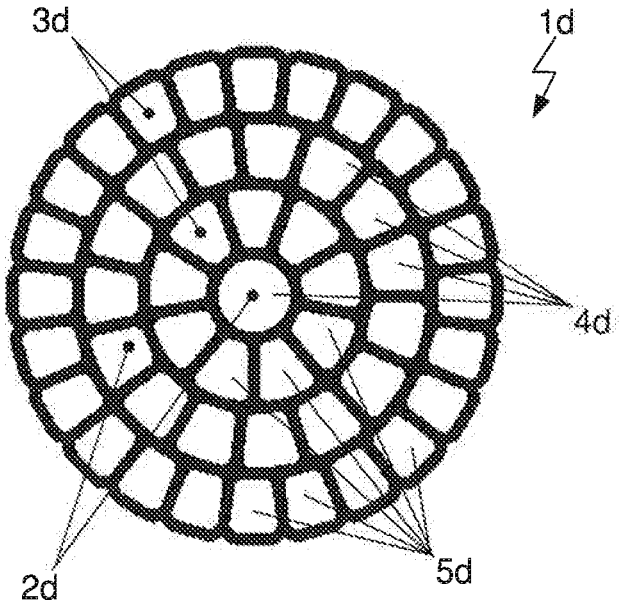
Figure 5:
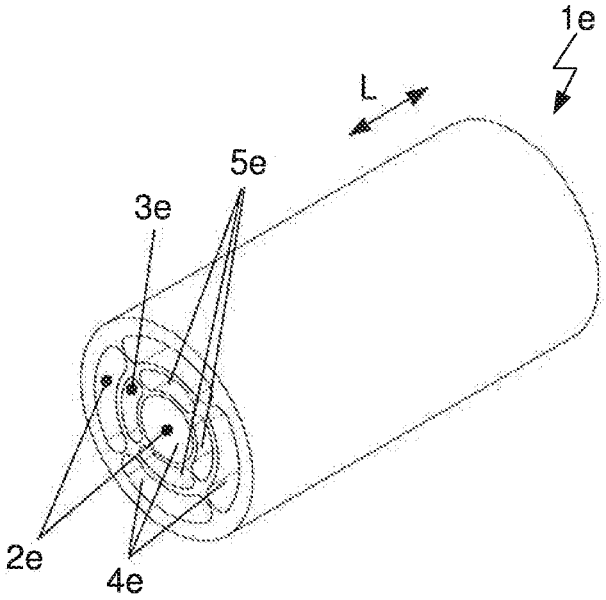

Further details, features and advantages of embodiments of the invention are evident in the following description of embodiment examples with reference to the associated drawing. Therein depicts in each Figure a device for heat exchange with first and second flow paths disposed coaxially with respect to one another:

FIG. 1*a*-1*e*: in cross section and in perspective view, respectively, flow paths developed with circular flow channels, wherein the flow channels of the first flow path form a circular flow path and the flow channels of the second flow path are disposed as a circular ring about the first flow path, FIG. 2: in cross section and perspective view flow paths implemented with circular flow channels which are disposed, from the inside toward the outside, adjacently as circular rings, FIG. 3*a*, 3*b*: in cross section with flow paths, implemented with circular flow channels, disposed, from the inside to the outside, adjacently and alternatingly as circular rings, FIG. 3*c*: from FIG. 3*a* in cross section with flow paths implemented of circular flow channels adapted to interspaces, FIG. 4: in cross section flow paths, implemented with one circular flow channel and rectangular flow channels, which are disposed, from the inside to the outside, adjacently as circular rings, FIG. 5: in perspective view in cross section with flow paths, implemented with one circular flow channel and elongated as well as curved flow channels, which are disposed, from the inside to the outside, adjacently as circular rings, FIG. 6*a*-6*e*: in a configuration with a connection element each for the first and the second flow path or with a combination connection element.

In FIG. 1*a* to 1*e* a device 1*a* for heat exchange with first and second flow paths 2*a*, 3*a*, disposed coaxially with respect to one another, is shown in cross section and in perspective view along the direction of flow, respectively, which direction of flow corresponds to the longitudinal direction L. The device 1*a* is substantially developed in circular cylindrical form and extends in a longitudinal direction L.

The flow paths 2*a*, 3*a* are each implemented with flow channels 4*a*, 5*a* that are circular in cross section. The flow channels 4*a* of the first flow path 2*a* form a circular flow path and the flow channels 5*a* of the second flow path 3*a* are disposed in the form of a circular ring about the first flow path 2*a*. The flow channels 4*a* of the first flow path 2*a* are identical as are the flow channels 5*a* of the second flow path 3*a*, wherein the flow channels 4*a* of the first flow path 2*a* can differ from the flow channels 5*a* of the second flow path 3*a*. The differences refer in particular to the free flow cross sections as well as the wall thicknesses and therewith to the inner and outer radii or the diameters.

As the throughflow areas, the free cross sections of the flow paths 2*a*, 3*a* can correspond approximately to the throughflow areas of the coaxial tubes of aluminum known within prior art.

The flow channels 4*a*, 5*a* extend in a straight line and parallel along the longitudinal direction L. According to an embodiment, not shown, the flow channels 4*a*, 5*a* are disposed in the longitudinal direction L turned or twisted about a center axis of the device.

FIGS. 1*a*, 1*d* and 1*e* show clearly that the flow channels 4*a*, each spaced apart at the same distance from the center axis of the device 1*a* and therewith from the flow channel 4*a*, disposed in the center, of the first flow path 2*a*, according to a first embodiment are aligned circularly about the center axis. The number of flow channels 4*a* per circle increases with increasing distance from the center axis.

According to a second embodiment, not shown, the number of flow channels 4*a* per circle remains constant with increasing distance from the center, wherein the outer radii of the flow channels 4*a* increase with increasing distance from the center axis.

In the device 1*a* depicted in FIGS. 1*b* and 1*c* the flow channels 4*a* of the first flow path 2*a* according to a second embodiment are each aligned in rows with respect to one another in a direction perpendicular to the longitudinal direction L, The flow channels 4*a* of adjacently disposed rows are each aligned offset with respect to one another about the outer radius of the flow channel 4*a*. The number of flow channels 4*a* per row increases with increasing distance from the row disposed through the center axis.

As the flow channels 4*a* of the first flow path 2*a*, the flow channels 5*a* of the second flow path 3*a* can each be disposed in the first or the second embodiment, wherein the flow channels 5*a* of the second flow path 3*a* can also be disposed in the first embodiment and the flow channels 4*a* of the first flow path 2*a* in the second embodiment, or conversely. The different embodiments refer herein to the formation of the diameters of the flow channels depending on the distance from the center axis.

FIG. 2 depicts in perspective view along the direction of flow a device 1*b* in cross section for heat exchange with first and second flow paths 2*b*, 3*b*, disposed coaxially with respect to one another.

In contrast to the device 1*a* of FIGS. 1*a*, 1*d* and 1*e*, the flow channels 4*b* of the first flow paths 2*b* and the flow channels 5*b* of the second flow paths 3*b* form each circular ring-shaped flow paths 2*b*, 4*b*, which are disposed, from the inside to the outside, adjacently as circular rings. Only the circular flow channel 4*b* disposed in the center as the single component forms a first flow path 2*b*.

In the direction of the radius of the device 1*b* the first flow paths 2*b* are each implemented as circular rings with the width of one flow channel 4*b*, i.e. implemented of one flow channel 4*a*, while the second flow paths 3*b* are implemented with the width of two flow channels 5*b*, i.e. implemented of two flow channels 5*b*. Each first flow path 2*b* is therewith encompassed by two flow channels 5*b* of the second flow path 3*b*. The flow channels 5*b* of the second flow paths 3*b*, adjacently disposed in the direction of the radius of device 1*b*, are disposed in contact with one another.

The flow paths are disposed, starting at the center toward the outside, in the sequence first flow path 2*b*, second flow path 3*b*, first flow path 2*b*, second flow path 3*b*, first flow path 2*b* as well as second flow path 3*b*.

The total throughflow area of the first flow paths 2*b* is in the range of 180 mm to 450 $mm^2$, in particular in the range, for example, of 200 $mm^2$ to 420 $mm^2$, specifically in the range of 300 $mm^2$ to 420 $mm^2$, while the total throughflow area of the second flow paths 3*b* is in the range of 40 $mm^2$ to 100 $mm^2$, in particular approximately 50 $mm^2$ or 70 $mm^2$, specifically in the range of 45 $mm^2$ to 63 $mm^2$.

When operating the device 1*b* as internal heat exchanger of a refrigerant circuit, the first flow paths 2*b* are passed through by refrigerant at low-pressure level and the second flow paths 3*b* by refrigerant at high-pressure level. Due to the material-specific properties of the refrigerant on the high-pressure side, the requisite total throughflow area is herein markedly lower on the high-pressure side than the requisite total throughflow area on the low-pressure side.

A flow channel 4*b* of the first flow path 2*b* has an inner diameter in the range of 0.8 mm to 1.5 mm, preferably of 1.2 mm, and a wall thickness in the range of 0.1 mm to 0.3 mm, preferably of 0.2 mm. A flow channel 5*b* of the second flow path 3*b* is also developed with an inner diameter in the range of 0.8 mm to 1.5 mm, preferably of 1.2 mm, as well as a wall thickness in the range of 0.2 mm to 0.6 mm, preferably of, for example, 0.4 mm, specifically of 0.37 mm.

The device 1*b* has an outer diameter in the range of 20 mm to 30 mm, preferably in the range of 22 mm to 27 mm, specifically in the range of 24 mm to 26 mm, and is scalable in size, in particular in total diameter. The configuration, or the number of flow paths 2*b*, 3*b*, and that of the flow channels 4*b*, 5*b* forming the flow paths 2*b* 3*b*, can herein be varied.

In FIG. 3*a* is depicted in cross section in perspective view along the direction of flow, a device 1*c*' for heat exchange with first and second flow paths 2*c*, 3*c* disposed coaxially with respect to one another. In contrast to the device 1*b* of FIG. 2, the flow channels 4*c*' of the first flow paths 2*c* and the flow channels 5*c* of the second flow paths 3*c* form each circular ring-shaped flow paths 2*c*, 4*c*' which, starting from the inside to the outside, are disposed adjacently and alternatingly as circular rings.

The essential difference from the device 1*b* of FIG. 2 is consequently that in the direction of the radius of the device 1*c*' the first flow paths 2*c* as well as also the second flow paths 3*c* are each developed as circular rings with the width of a flow channel 4*c*', 5*c*, i.e. formed of a flow channel 4*c*', 5*c*. Each first flow path 2*c* is therewith in each instance encompassed by a second flow path 3*c*. The first flow path 2*c* located at the outer radius can, furthermore, be encompassed by a second flow path 3*c*, which is not shown in FIG. 3*a*.

On the outside as well as also on the inside, the flow channels 5*c* of the second flow paths 3*c* are in direct thermal contact with a flow channel 4*c*' of the first flow paths 2*c*. The flow channels 4*c*', 5*c*, disposed adjacently in the direction of the radius of device 1*c*', of a type of flow path 2*b*, 3*b* are disposed such that they are not in contact with one another. The terms outside and inside always refer to the outer wall of the flow channels 4*c*', 5*c* depending on the radius of the device 1*c*'.

FIG. 3*b* depicts a detailed view of the device 1*c*' of FIG. 3*a*. By forming constant wall thicknesses and constant numbers of flow channels 4*c*', 5*c* either overlappings of the walls of the flow channels 4*c*', 5*c* occur or undesirable as well as unused interspaces between adjacent flow channels 4*c*', 5*c* develop. To the interspaces no fluid for heat exchange is applied and, as potential insulation, would affect and impair the heat transfer. Due to the specified pressure loading, the wall thicknesses are predetermined.

Maintaining the flow channels 5*c*, circular in cross section, of the second flow paths 3*c*, the flow channels 4*c* of the first flow paths 2*c* have to be adapted.

FIG. 3*c* depicts a detailed view of a device 1*c* with a cross section with circular flow channels 5*c* of the second flow paths 3*c* as well as, by example, a flow channel 4*c* of a first flow path 2*c* adapted to the interspaces between the second flow paths 3*c*.

At the contact sides with the flow channels 5*c*, the wall of flow channel 4*c* is herein adapted to the wall of the flow channels 5*c* and formed concavely such that the walls of the adjacently disposed flow channels 4*c*, 5*c* are fully in contact over their entire area. The radii of the outsides of the walls of the flow channels 4*c*, 5*c* are identical.

The walls of flow channels 4*c* at the contact sides with one another, i.e. in the circumferential direction, are planar and are also fully in contact with one another over their entire surface. The planar walls are each preferably oriented in the direction of the radius of device 1*c*.

When operating the device 1*c* as internal heat exchanger of a refrigerant circuit, the flow channels 4*c*, adapted in cross section, of the first flow paths 2*c* are passed through by refrigerant at low pressure level and the circular flow channels 5*c* of the second flow paths 3*c* by refrigerant at high pressure level.

Herein, furthermore, the disposition of the flow channels 4*c*, 5*c* of device 1*c* according to FIG. 3*c*, as refrigerant flow channels in direct thermal contact with the refrigerant at high pressure level and the refrigerant of low pressure level, is to be preferred to the disposition of the flow channels 4*b*, 5*b* of device 1*b* according to FIG. 2 in a double row of the second flow channels 5*b* for the high pressure flow.

The devices 1*a*, 1*b*, 1*c* according to FIG. 1*a* to 1*e* and FIG. 2 as well as 3*a* to 3*c* can be implemented such that the first flow paths 2*a*, 2*b*, 2*c* as well as also the second flow paths 3*a*, 3*b*, 3*c* are each implemented as one integral element, which at the assembly of the device 1*a*, 1*b*, 1*c* are connected with one another as integral elements, in particular are plugged one into the other.

In FIG. 4 is depicted in cross section a device 1*d* for heat exchange with first and second flow paths 2*d*, 3*d*, coaxially disposed with respect to one another, with flow paths 2*d*, 3*d* formed of a circular, centrally disposed flow channel 4*d* and rectangular flow channels 4*d*, 5*d*, which flow paths 2*d*, 3*d* are, from the inside out, disposed adjacently as circular rings. Only the flow channel 2*d* in the center of the device 1*d* has a circular flow cross-section.

The device 1*d* is comprised of several circular cylindrical tubes disposed coaxially, wherein the flow paths 2*d*, 3*d*, from the inside out, are in each instance disposed such they are alternatingly adjacent. Between the adjacent tubes are developed fins or webs distributed uniformly over the circumference. The fins or webs, disposed in the direction of the radius of device 1*d*, divide the flow paths 2*d*, 3*d* into the flow channels 4*d*, 5*d*, each of which is delimited in the circumferential direction by a tube wall and in the direction of the radius by a fin.

In comparison with the devices 1*a*, 1*b*, 1*c* according to FIG. 1 to 3, in which each flow channel 4*a*, 4*b*, 4*c*, 5*a*, 5*b*, 5*c* is delimited by its own wall and the walls of adjacently disposed flow channels 4*a*, 4*b*, 4*c*, 5*a*, 5*b*, 5*c* are in contact on one another, the flow channels 4*d*, 5*d* of device 1*d* of FIG. 4 have walls which delimit the flow channels 4*d*, 5*d* on both sides. Thus one wall separates flow channels 4*d*, 5*d* either of a first flow path 2*d* or of a second flow path 3*d* or it separates the flow channels 4*d*, 5*d* of different flow paths 2*d*, 3*d* from one another.

FIG. 5 depicts in perspective view a device 1*e* in cross section for heat exchange with first and second flow paths 2*e*, 3*e*, coaxially disposed with respect to one another, with the flow paths 2*e*, 3*e* implemented as a circular flow channel 4*e* and partial circular ring-shaped flow channels 4*e*, 5*e* which, from the inside out, are disposed adjacently as circular rings. Only the flow channel 4*d*, disposed in the center of device 1*e* has a circular flow cross section.

The essential difference from the device 1*d* of FIG. 4 consists in the form of the cross sections of the partial circular ring-shaped flow channels 4*e*, 5*e* being curved and elongated about the center axis of the circular cylindrical device 1*d*. Herein the four fins, disposed between the several circular cylindrically tubes that are coaxial with respect to one another and adjacent, are distributed uniformly over the circumference such that each flow channel 4*e*, 5*e*, with the exception of the flow channel 4*e* in the center, describes a quarter circular ring.

The embodiments of the devices 1*d*, 1*e* according to FIGS. 4 and 5 are also scalable, wherein in particular the disposition or the number of flow paths 2*d*, 2*e*, 3*d*, 3*e* are varied.

To distribute the fluid mass flow, between which the heat is to be transferred, for example when operating the device 1*a*, 1*b*, 1*c*, 1*d*, 1*e* as internal heat exchanger of a refrigerant circuit, between the refrigerant mass flows at high-pressure level and at low-pressure level, onto the individual flow channels 4*a*, 4*b*, 4*c*, 4*d*, 4*e*, 5*a*, 5*b*, 5*c*, 5*d*, 5*e* and to combine them again after they have passed through the device 1*a*, 1*b*, 1*c*, 1*d*, 1*e*, connection components are to be provided.

FIG. 6*a* to 6*e* depict each a configuration of devices 1*a*, 1*b*, 1*c*, 1*d*, 1*e*, 1*f*, 1*g*, 1*h*, 1*i* for heat exchange with first and second flow paths 2*f*, 2*g*, 2*h*, 2*i*, 3*f*, 3*g*, 3*h*, 3*i*, disposed coaxially with respect to one another, and each with either a connection element 6, 6*f* for the first flow path 2*f* and a connection element 7, 7*f* for the second flow path 3*f* or a combination connection element 11*g*, 11*h*, 11*i*.

The connection elements 6, 6*f*, 7, 7*f*, and the combination connection elements 11*g*, 11*h*, 11*i*, respectively, are each connected with one another and with the device 1*a*, 1*b*, 1*c*, 1*d*, 1*e*, 1*f*, 1*g*, 1*h*, 1*i* for example by means of adhesion, deforming, friction welding or welding. The connection elements 6, 6*f*, 7, 7*f* or the combination connection elements 11*g*, 11*h*, 11*i* advantageously comprise peanut fittings as connection elements to the connection lines.

Figure 6A:
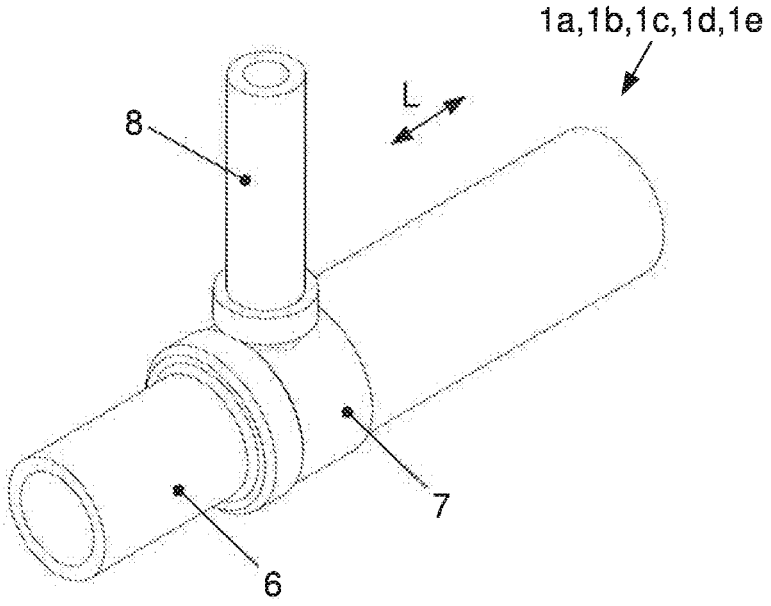
Figure 6B:
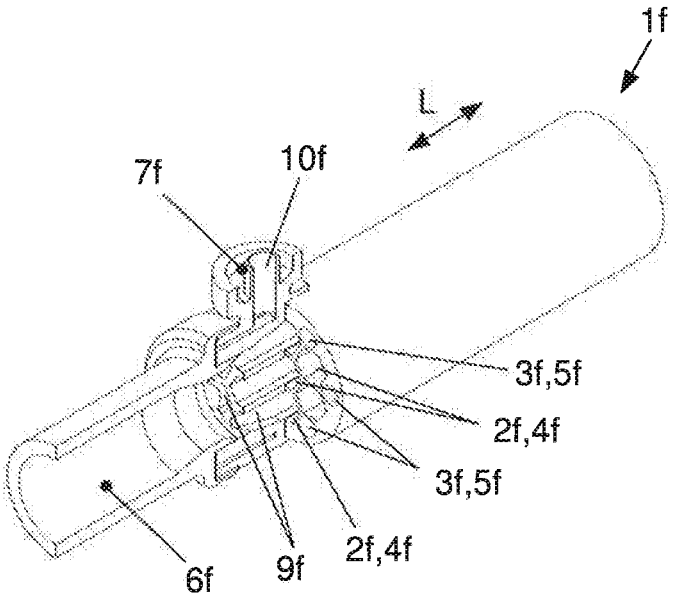

As shown in FIGS. 6*a* and 6*b* at each of the front faces in the axial, and thus in the longitudinal, direction of the device 1*a*, 1*b*, 1*c*, 1*d*, 1*e*, if one connection element 6, 6*f* for the first flow path 2*f* is disposed. Between the particular front face of device 1*a*, 1*b*, 1*c*, 1*d*, 1*e*, 1*f* and the connection element 6, 6*f* for the first flow path, moreover, a connection element 7, 7*f* for the second flow path 3*f* is to be provided.

Depending on the direction of flow, the first fluid mass flow flowing into the first flow paths 2*f* is conducted through the connection element 6, 6*f* to the connection element 7, 7*f* and in the connection element 7, 7*f* distributed onto the flow channels 4*f* of the first flow paths 2*f* or the first fluid mass flow flowing out of the flow channels 4*f* of the first flow paths 2*f* is conducted through the connection element 7, 7*f* to the connection element 6, 6*f* and is mixed in the connection element 6, 6*f*. The connection element 6, 6*f* is connected with a connection line, not shown, to conduct the first fluid mass flow. Depending on the direction of flow, the second fluid mass flow flowing into the second flow paths 3*f* is distributed in the connection element 7, 7*f* onto the flow channels 5*f* of the second flow paths 3*f* or the second fluid mass flow flowing out of the flow channels 5*f* of the second flow paths 3*f* is conducted through the connection element 7, 7*f* and is mixed in a connection line 8 for conducting the second fluid mass flow. The connection line 8 is connected with the connection element 7, 7*f*.

FIG. 6*b* depicts in perspective view a device if in a cross section for heat exchange with first and second flow paths 2*f*, 3*f*, coaxially disposed with respect to one another, with flow channels 4*f*, implemented of honeycomb-shaped, in particular hexagonal, and specifically developed as hexagons, of the first flow paths 2*f* and circularly formed flow channels 5*f* of the second flow paths 3*f*.

The essential differences from the device 1*e* of FIG. 5 are the developments of the shapes of the cross sections as well as the disposition of the flow channels 4*f*, 5*f*, wherein the flow channels 4*f* are aligned as seven honeycombs with six individual honeycombs disposed uniformly about a single honeycomb in the center. The twelve fins formed between the honeycombs are herein distributed uniformly over the circumference. In terms of shape and dimension the honeycombs have identical flow cross sections. In the interspaces between each two of the six outer honeycombs and the outer diameter of device 1*f* the flow channels 5*f* are developed with the circular flow cross sections which are also uniformly distributed over the circumference.

At its core the connection element 7*f* has honeycomb-shaped connection flow channels 9*f*, which are developed and disposed such as to continue the flow channels 4*f* of the first flow paths 2*f* in the longitudinal direction L. The front faces in contact with one another of the device 1*f* and of the connection element 7*f* are identical in size and disposition of the honeycomb-shaped flow channels 4*f* and of the connection flow channels 9*f*, such that the flow channels 4*f* are extended through the connection element 7*f* up to the connection element 6*f*. Starting from the front face oriented toward the device 1*f*, the connection flow channels 9*f* taper on the way through the connection element 7*f*. In the connection element 6*f* the first fluid is distributed or mixed, depending on the direction of flow.

About the connection flow channels 9*f* disposed in the core a ring channel is realized as connection flow channel 10*f* of the second flow paths 3*f*, which ring channel is open in the direction toward the front face of the connection element 7*f* and encompasses, together with the circular flow channels 5*f* of the second flow paths 3*f*, a common volume. At the front faces of the device 1*f* and of connection element 7*f* the flow paths 3*f* open out into the common ring channel. The ring channel, in turn, is provided with an outlet opening which is disposed substantially perpendicularly to the longitudinal direction L and into which leads the connection line, not shown. In the ring channel of connection element 7*f* the second fluid is distributed or mixed, depending on the direction of flow.

Figure 6C:
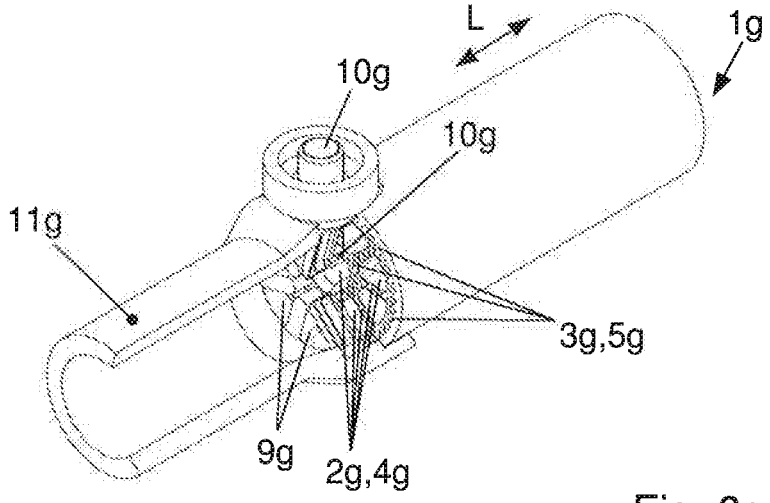

FIG. 6*c* depicts a perspective view of a device 1*g* in cross section for heat exchange with first and second flow paths 2*g*, 3*g*, disposed coaxially with respect to one another, with circularly implemented flow channels 4*g*, 5*g* of the first and the second flow paths 2*g*, 3*g* as well as rectangularly implemented flow channels 4*g* of the first flow paths 2*g*.

Similarly to the device 1*d* of FIG. 4, the device 1*g* is implemented of several, in particular two, coaxial circular cylindrical tubes, wherein the flow paths 2*g*, 3*g*, from the inside out, are disposed such that they are alternatingly adjacent. Between the adjacent tubes fins, uniformly distributed over the circumference, are implemented. The fins, disposed in the direction of the radius of the device 1*g*, distribute the flow paths 2*g*, 3*g* onto the flow channels 4*g*, 5*g*, which are each delimited in the circumferential direction by a tube wall and in the direction of the radius by a fin.

In contrast to the device 1*d* of FIG. 4, the walls forming the tube wall as well as also the walls forming the fins in the longitudinal direction are also provided with circular flow channels 4*g*, 5*g*. While within the tube proper and in the circular flow channels 5*g* developed in the fins, the first fluid flows through the flow channels 4*g* of the first flow paths 2*g*, the circular flow channels 5*g*, formed within the tube walls, of the second flow paths 3*g* are charged with the second fluid.

In the longitudinal direction L the combination connection element 11*g* comprises continuous connection flow channels 9*g*, which are implemented and disposed such that they continue the flow channels 4*g* of the first flow paths 2*g*. In the proximity of the fins of device 1*g* the combination connection element 11*g* is developed with webs which extend from the outer wall in the direction of the radius up to the height of the wall of the inner tube and, in the proximity of the center, in particular in the proximity of the inner tube as a first flow path 2*g*, leave open the flow path 2*g*.

The webs are disposed on the front faces, oriented toward one another, of the device 1*g* and of the combination connection element 11*g* spaced apart from the fins of the device 1*g* such that the flow channels 4*g* developed in the fins, also open out into the volume left open by the webs. The first fluid flows substantially in the longitudinal direction L through the combination connection element 11*g* and, depending on the direction of flow, is distributed onto the flow channels 4*g* or the first fluid, flowing through the flow channels 4*g*, is at least partially mixed in the combination connection element 11*g*, flows subsequently through the combination connection element 11*g* and is lastly mixed after the webs.

The combination connection element 11*g* comprises about the connection flow channels 9*g*, disposed in the core, as well as at the ends of the webs at the height of the wall of the inner tube, a ring channel as the connection flow channels 10*g* of the second flow paths 3*g*, which are open in the direction toward the front face of the combination connection element 11*g* and, through channels formed in the webs encompass together with the circular flow channels 5*g* of the second flow paths 3*g* of the device 1*g*, a common volume. The flow paths 3*g*, developed in the wall of the inner tube, open at the front faces of the device 1*g* and of the combination connection element 11*g* out into an inner ring channel and the flow paths 3*g* developed in the wall of the outer tube open at the front faces of the device 1*g* and of the combination connection element 11*g* out into an outer ring channel. The inner ring channel and the outer ring channel are fluidically connected with one another via the channels developed in the webs. The outer ring channel, in turn, is provided with an outlet opening which is oriented substantially perpendicularly to the longitudinal direction L and into which lead connection lines, not shown. In the ring channels of the combination connection element 11*g* the second fluid is either distributed or mixed depending on the direction of flow.

Figure 6D:
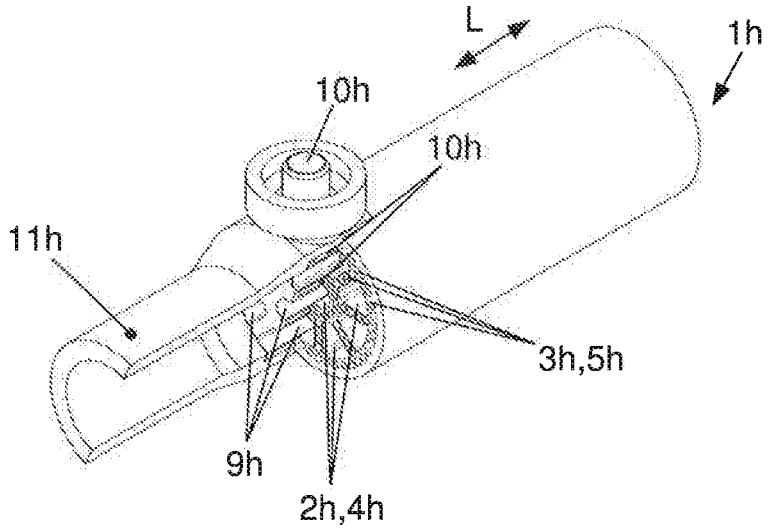

FIG. 6*d* depicts in perspective view a device 1*h* in a cross section for heat exchange with first and second flow paths 2*h*, 3*h*, disposed coaxially with respect to one another, with flow channels 5*h*, developed circularly, of the second flow paths 3*h* as well as rectangularly developed flow channels 4*h* of the first flow paths 2*h*.

In contrast to the device 1*g* of FIG. 6*c*, the flow channels 5*h*, implemented circularly in the tube walls and the fins, as the second flow paths 3*h* are charged with the second fluid while within the tube proper the first fluid flows through the flow channels 4*h* of the first flow paths 2*h*.

The combination connection element 11*h* in a cross section comprises in its core a central circular connection flow channel 9*h* and rectangular connection flow channels 9*h* disposed about the central connection flow channel 9*h*, which are developed and disposed such that they continue the flow channels 4*h* of the first flow paths 2*h* in the longitudinal direction L. The front faces of the device 1*h* and of the combination connection element 11*h* in contact with one another are identical in terms of size and disposition of the flow channels 4*h* and connection flow channels 9*h* or they are at least nearly identical, such that the flow channels 4*h* are extended into the combination connection element 11*h*. The connection flow channels 9*h* end within the combination connection element 11*h* and open out into a common volume. In the combination connection element 11*h* the first fluid is distributed or mixed depending on the direction of flow. In the proximities of the fins of device 1*h* the combination connection element 11*h* is provided with webs which extend from the outer wall in the direction of the radius up to a circular ring disposed in the proximity of the wall of the inner tube of the device 1*h*. In the proximity of the inner tube the circular ring comprises a connection flow channel 9*h* with circular flow cross section as a first flow path 2*h*. At the front faces of the device 1*h* and of the combination connection element 11*h* the webs and the circular ring are in contact on the fins and the inner tube of the device 1*h*.

The combination connection element 11*h* comprises one ring channel each about the connection flow channels 9*h*, disposed in the core, as well as in the interior of the circular ring as connection flow channels 10*h* of the second flow paths 3*h*, which, like the webs, are open in the direction of the front face of the combination connection element 11*h* and, with the channels developed in the webs and the circular flow channels 5*h* of the second flow paths 3*h* of the device 1*h*, encompass a common volume. The flow paths 3*h* developed in the wall of the inner tube open at the front faces of the device 1*h* and of the combination connection element 11*h* out into an inner ring channel and the flow paths 3*h* developed in the wall of the outer tube, open at the front faces of the device 1*h* and of the combination connection element 11*h* out into an outer ring channel. The flow paths 3*h* developed in the fins open each at the front faces of device 1*h* and of the combination connection element 11*g* out into a channel developed in a web.

The inner ring channel and the outer ring channel are, moreover, fluidically connected with one another across the channels developed in the webs. The outer ring channel is provided with an outlet opening which is oriented substantially perpendicularly to the longitudinal direction L and into which the connection line, not shown, opens out. In the ring channels and in the channels developed in the webs of the combination connection element 11*h* the second fluid is distributed or mixed depending on the direction of flow.

Figure 6E:
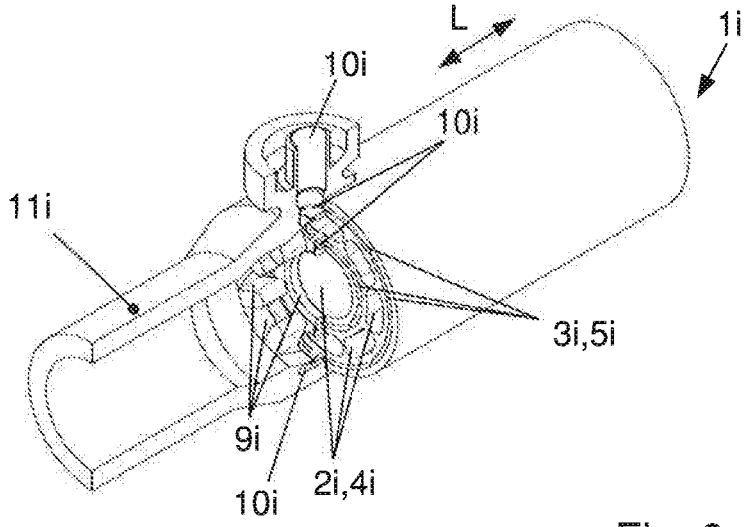

FIG. 6*e* depicts in perspective view a device 1*i* in cross section for heat exchange with first and second flow paths 2*i*, 3*i* disposed coaxially with respect to one another, with flow paths 2*i*, 3*i*, developed with circular flow channel 4*i* and partial circular ring-shaped flow channels 4*i*, 5*i*, which, from the inside out, are disposed adjacently as circular rings. Only the flow channel 2*i* located in the center of the device 1*i* has a circular flow cross section.

In contrast to the device 1*e* of FIG. 5, three flow paths 2*i*, 3*i* are developed instead of two flow paths 2*e*, 3*e* disposed coaxially with respect to one another and disposed about the inner circular flow cross section as well as developed of partial circular ring-shaped flow channels 4*e*, 5*e*.

The combination connection element 11*i* corresponds substantially to the combination connection element 11*h* of FIG. 6*d*. The essential difference of the combination connection element 11*h*, 11*i* lies in the implementation of the webs which are closed in the direction of the front face of the combination connection element 11*i* and only form fluidic connections between the ring channels. The webs, moreover, at the front faces facing one another of the device 1*i* and of the combination connection elements 11*i* are not absolutely in contact on the fins and the inner tube of the device 1*i*.

The devices 1*a*, 1*b*, 1*c*, 1*d*, 1*e*, 1*f*, 1*g*, 1*h*, 1*i* are in particular directed at heat exchangers developed as coaxial tube heat exchangers, wherein the utilized mechanisms, materials and designs are also applicable to other types of heat exchangers.

The devices 1*a*, 1*b*, 1*c*, 1*d*, 1*e*, 1*f*, 1*g*, 1*h*, 1*i* permit their employment as internal heat exchangers of a refrigerant circuit which is employable for diverse refrigerants such as R1234yf, R1234ze, R134a, R290, R600a, R600, R717, R744, R32, R152a, R1270, R1150 and their mixtures.

LIST OF REFERENCE SYMBOLS

1*a*, 1*b*, 1*c*', 1*c*, 1*d*, 1*e*, 1*f*, 1*g*, 1*h*, 1*i* Device
2*a*, 2*b*, 2*c*, 2*d*, 2*e*, 2*f*, 2*g*, 2*h*, 2*i* First flow path
3*a*, 3*b*, 3*c*, 3*d*, 3*e*, 3*f*, 3*g*, 3*h*, 3*i* Second flow path
4*a*, 4*b*, 4*c*', 4*c*, 4*d*, 4*e*, 4*f*, 4*g*, 4*h*, 4*i* Flow channels first flow path
5*a*, 5*b*, 5*c*, 5*d*, 5*e*, 5*f*, 5*g*, 5*h*, 5*i* Flow channels second flow path
6, 6*f* Connection element first flow path
7, 7*f* Connection element second flow path
8 Connection line second fluid
9*f*, 9*g*, 9*h*, 9*i* Connection flow channel first flow path
10*f*, 10*g*, 10*h*, 10*i* Connection flow channel second flow path
11*g*, 11*h*, 11*i* Combination connection element
L Longitudinal direction

The invention claimed is:

1. A device for heat exchange comprising a plurality of first flow paths and a plurality of second flow paths which, in a cross section perpendicular to a longitudinal direction (L) of the device, are disposed coaxially with respect to one another, wherein each of the flow paths comprise a plurality of first and second flow channels and one wall of the plurality of first and second flow channels of at least one of the first or second flow paths is realized from a synthetic material or a metal; wherein each flow channel is developed with a separate wall, wherein the walls of adjacently disposed flow channels are in contact on one another; and a connection element, wherein the connection element comprises a first and a second connection element, wherein the first connection element includes flow channels for the first flow path and a flow channel for the second flow path, wherein the first connection element is engaged to the second connection element, thereby preventing a fluid in each of the first and second flow path from being mixed.

2. A device according to claim 1, wherein at least one flow path is implemented as a multiplicity of flow channels each with circular flow cross section.

3. A device according to claim 2, wherein one wall of at least one flow channel of at least one of the second flow paths is realized from a metal.

4. A device according to claim 1, wherein at least one of the first flow paths is disposed proximately to an axis of symmetry of the device and has a circular form in cross section, and the flow channels of a second flow path are disposed coaxially about the at least one of the first flow paths which have a circular ring form.

5. A device according to claim 4, wherein, starting at the axis of symmetry toward an outside, flow channels of one of the first flow paths are disposed coaxially about flow channels of one of the second flow paths which have a circular ring form, wherein at least one of the second flow paths is delimited by two of the first flow paths and wherein flow channels of one of the second flow paths are disposed coaxially about flow channels of one of the first flow paths which a circular ring.

6. A device according to claim 4, wherein the flow channels of the plurality of first or second flow paths are disposed in a single row or in multiple rows.

7. A device according to claim 1, wherein the flow channels of the plurality of first or second flow paths are aligned parallel to one another in the longitudinal direction (L).

8. A device according to claim 1, wherein at least one of the at least one of the first or second flow paths has circular ring-shaped in a cross section perpendicular to the longitudinal direction (L), wherein the flow path is distributed into partial circular ring-shaped flow channels by webs oriented in the direction of a radius.

9. A device according to claim 1, wherein at front faces of the device one connection element for the first flow paths and the first connection element for the first flow paths and the second connection element for the second flow paths are disposed in which are disposed connection flow channels continuing the flow channels of the first flow paths in the longitudinal direction (L).

10. A device for heat exchange comprising a plurality of first flow paths and a plurality of second flow paths which, in a cross section perpendicular to a longitudinal direction (L) of the device, are disposed coaxially with respect to one another, wherein each of the flow paths comprise a plurality of first and second flow channels and one wall of the plurality of first and second flow channels of at least one of the first or second flow paths is realized from a synthetic material or a metal; wherein the walls of adjacently disposed flow channels are in contact on one another, wherein each flow channel is developed such that each flow channel is delimited by a wall, wherein adjacently disposed flow channels are in each instance separated from each other by a common wall; and a connection element, wherein the connection element comprises a first and a second connection element, wherein the first connection element includes a flow channels for the first flow path and a flow channel for the second flow path, wherein the first connection element is engaged to the second connection element, thereby preventing a fluid in each of the first and second flow path from being mixed.

11. A device for heat exchange comprising:

at least one first flow path and at least one second flow path which, in a cross section perpendicular to a longitudinal direction of the device, are disposed coaxially with respect to one another, wherein each with either a connection element for the at least one first flow path and a connection element for the at least one second flow path or a combination connection element; and wherein the connection element comprises a first and a second connection element, wherein the first connection element includes a flow channels for the first flow path and a flow channel for the second flow path, wherein the first connection element is engaged to the second connection element, thereby preventing a fluid in each of the first and second flow path from being mixed; wherein the connection elements are each connected with one another and with the device or the combination connection element is connected with the device;

wherein the connection element or the combination connection element comprise fittings as connection elements to the connection lines.

12. A device for heat exchange according to claim 11, wherein at each front face in the longitudinal direction of the device the connection element for the first flow path is disposed, and wherein between the particular front face of the device and the connection element for the first flow path the connection element for the second flow path is provided.

13. A device for heat exchange according to claim 11, wherein flow channels are honeycomb-shaped.

14. A device for heat exchange according to claim 11 having circularly implemented flow channels of the first and the second flow paths or rectangularly implemented flow channels of the first flow paths.

15. A device for heat exchange according to claim 11, wherein the device comprises two coaxial circular cylindrical tubes, wherein the at least one of the first and second flow paths are disposed such that they are alternatingly adjacent.

* * * * *